US006685109B2

(12) United States Patent
Py

(10) Patent No.: US 6,685,109 B2
(45) Date of Patent: Feb. 3, 2004

(54) SYSTEM AND METHOD FOR A TWO PIECE SPRAY NOZZLE

(76) Inventor: Daniel Py, 8 Normandy Rd., Larchmont, NY (US) 10538

( * ) Notice: Subject to any disclaimer, the term of this patent is extended or adjusted under 35 U.S.C. 154(b) by 0 days.

(21) Appl. No.: 09/962,949

(22) Filed: Sep. 24, 2001

(65) Prior Publication Data

US 2003/0057297 A1 Mar. 27, 2003

(51) Int. Cl.[7] ..... B05B 1/34

(52) U.S. Cl. ..... 239/461; 239/333; 239/451; 239/460; 239/533.1; 239/490; 239/491

(58) Field of Search ..... 239/333, 451, 239/452, 453, 455, 459, 460, 474, 476, 483, 533.13, 461, 533.1, 482, 490, 491, 493, 546, 569

(56) References Cited

U.S. PATENT DOCUMENTS 5,370,313 A * 12/1994 Beard ..... 239/337
5,855,322 A * 1/1999 Py ..... 239/333
5,992,764 A * 11/1999 Bougamont et al. ..... 239/459
6,234,365 B1 * 5/2001 Bougamont et al. ..... 222/490

* cited by examiner

*Primary Examiner*—Robin O. Evans
(74) *Attorney, Agent, or Firm*—Kenyon & Kenyon

(57) ABSTRACT

An aerosol tip mechanism for an aerosol-type dispenser for dispensing liquid content has a flexible outer shell, a rigid cap portion composed of lower and upper portions, and a rigid nozzle portion having a rigid shaft received within the outlet portion of the flexible outer shell. The rigid shaft interfaces the outlet portion of the outer shell, forming a first normally-closed one-way valve. The lower and upper portions of the rigid cap portion form boots adapted to receive an outlet portion of the flexible outer shell, the boots thereby constraining a lateral motion of the outlet portion of the outer shell, and symmetrically centering the outlet portion around the rigid shaft of the nozzle. The rigid nozzle portion includes a plurality of liquid channels for delivering liquid from a reservoir to a swirling chamber defined within the rigid cap portion, which liquid channels are configured to minimize energy losses of the liquid and promote a more homogeneous fluid particle size in the dispensed aerosol. The aerosol tip mechanism provides for long-term sterility of the stored fluid, which in turn allows for preservation of the sterility of non-chemically preserved formulations, which may be in the form of suspension or liquid gels.

13 Claims, 7 Drawing Sheets

SYSTEM AND METHOD FOR A TWO PIECE SPRAY NOZZLE

FIELD OF THE INVENTION

The invention relates to generally to a system and method for generating a spray or aerosol-type discharge, and relates more particularly to a system and method for generating a spray or aerosol discharge by means of a mechanical aerosol-tip mechanism which optimally controls the size of fluid particles in the discharge.

BACKGROUND INFORMATION

One of the problems encountered in the design of mechanical-spray or aerosol-type dispensers without a propellant gas is how to optimally control, and preferably reduce, the size of fluid particles to achieve an aerosol-type spray mist, and to narrow the range of the particle sizes, which translates into an optimal homogeneity of particle sizes. It is known in the art that mechanical energy losses incurred in the dispenser fluid conduit or channel, which energy losses are referred to as "head losses," are a major contributing factor in the formation of larger fluid-particle sizes in the released aerosol spray. Such head losses may be caused by, for example, interaction of the moving fluid and stationary walls of the dispenser, changes in geometry of the conduit, and other significant changes in the fluid flow pattern.

Applying fundamental equations from classical fluid dynamics, it can be shown that the head losses are related to specific geometric parameters of the fluid conduit such as the length and inner diameter of the fluid conduit and the sharpness of turning angles in the fluid path. The Bernoulli equation expresses the head loss ($H_L$) in terms of the energy conservation principle:

$$\left(\frac{p_1}{\gamma}+\frac{V_1^2}{2g}+z_1\right)-H_L=\left(\frac{p_2}{\gamma}+\frac{V_2^2}{2g}+z_2\right) \tag{1}$$

where p is pressure, V is velocity, γ is fluid density, g is gravitational constant, and z is elevation head. The Darcy-Weisbach equation derives a formula for major head losses in terms of the physical parameters of the fluid channel assuming laminar flow.

$$H_L(\text{Major})=f\left(\frac{L}{d}\right)\left(\frac{V^2}{2g}\right) \tag{2}$$

where f is a friction factor, V is the fluid velocity, L is the conduit length and d is the conduit diameter. Furthermore, minor head losses can also be expressed in terms of physical parameters:

$$H_L(\text{Minor})=K\left(\frac{V^2}{2g}\right) \tag{3}$$

where K is a minor loss coefficient related to specific geometry variations.

In addition to the physical parameters of the fluid and the conduit channel, another factor that affects the fluid-particle sizes in the released aerosol spray, for example in a one-way spray tip of the type described in U.S. Pat. No. 5,855,322, is the symmetry of the interface between the flexible nozzle portion, which distends in response to applied pressure, and the rigid shaft portion upon which the flexible portion normally rests. Asymmetries in the interface between the flexible portion and the rigid shaft, e.g., when the flexible portion is not properly centered on the rigid shaft, produce variable valve spacing, and result both in uneven fluid-particle size distributions, and in an overall increase of relatively large-sized fluid particles. FIG. 8 illustrates an example of asymmetry which may occur in aerosol tip mechanisms. FIG. 8 shows flexible left and right valve portions 401, 402 which are not symmetrically centered with respect to the rigid shaft 405. As can be discerned, the left flexible valve portion 401 overextends beyond the center axis of the rigid shaft 405, while the right flexible valve portion 402 under-extends. Other examples of asymmetrical interaction between the rigid shaft and the surrounding valve portions should be readily apparent.

A further problem in manufacturing spray/aerosol/dispensers is minimizing the number of components which constitute the spray/aerosol dispenser. As the number of components increases, the difficulty and cost of mass production consequently increases as well.

A further related problem is the costly development time needed for components from different subassemblies to be adjusted with the high precision required for alignment, e.g., in a sub-millimeter range.

It is an object of the present invention to provide a simple aerosol-type spray-tip mechanism ("aerosol tip mechanism"), e.g., a spray-tip mechanism including a nozzle for dispensing liquid from a pump-type dispenser in aerosol or spray form, which nozzle maximizes the conservation of energy in the fluid flow by minimizing head losses.

It is yet another object of the present invention to provide an aerosol-tip spray-tip mechanism in which the components of the outlet valve are centered with respect to one another, e.g., with respect to the central elongated axis of the spray-tip mechanism, thereby ensuring a symmetrical outlet valve interface.

It is another object of the present invention to provide a method of ensuring the components of the outlet valve of an aerosol-type spray-tip mechanism to be centered with respect to one another, e.g., with respect to the central elongated axis of the spray-tip mechanism, thereby ensuring a symmetrical outlet valve interface.

SUMMARY OF THE INVENTION

In accordance with the above objects, the present invention provides an aerosol tip mechanism for an aerosol-type dispenser for dispensing liquid content by application of pressure, which aerosol-tip mechanism has a symmetrical outlet valve, i.e., the components of the outlet valve are centered with respect to the central elongated axis of the aerosol-tip mechanism. The aerosol tip mechanism according to the present invention may be adapted for use with a variety of types of liquid-dispensing apparatuses, for example, aerosol dispensers which channel liquid from a liquid reservoir through the aerosol tip mechanism by application of pressure via a pump mechanism.

In one embodiment of the aerosol tip mechanism according to the present invention, the aerosol tip mechanism has a flexible outer shell, a rigid cap portion composed of lower and upper portions, and a rigid nozzle portion having a rigid shaft received within the outlet portion of the flexible outer shell. The rigid shaft interfaces the outlet portion of the outer shell to form a first normally-closed valve. The lower and upper portions of the cap portion form boots which receives the outlet portion of the flexible outer shell and constrains lateral motion of the outlet portion of the outer shell. The boots of the cap symmetrically center the outlet portion of the flexible outer shell around the rigid shaft of the nozzle.

In the above-described embodiment, the aerosol tip mechanism further includes a swirling chamber that is laterally delimited by the rigid shaft of the nozzle in a central location and by the lower portion of the cap portion, and vertically delimited above by the outlet portion of the outer shell and underneath by the base connected to the rigid shaft. The aerosol dispenser is in fluid communication with a liquid reservoir from which liquid is channeled through a plurality of fluid channels within the rigid nozzle portion. Each of the fluid channels leads to one of a plurality of spiral feed channels that are gradually curved to minimize head losses as the liquid flows through the feed channels. Liquid channeled through the spiral feed channels continues in a spiral path into the swirling chamber in which the liquid is swirled before being released as an aerosol via the first normally-closed valve. The bottom of the trough (shown as 410 in FIG. 6 and FIG. 8) of the swirling chamber surrounding the nozzle central shaft, which trough receives the flow from each feed channel, has also been designed to minimize the head losses caused by collision of fluid arriving from fluid channels and fluid already orbiting in the trough. A ramp (shown as 411 in FIG. 6) at the end of each fluid channel raises the bottom of the trough so that when the liquid from a feed channel enters the trough, it is disposed at least partially under the already-orbiting fluid from the adjacent feed channel. This arrangement reduces fluid collisions, and as a consequence, when the liquid reaches the upper outlet of the swirl chamber, it has maximal celerity and pressure.

The aerosol tip mechanism of a fluid dispenser according to the present invention allows a smaller number of component parts to be assembled and also allows for improved concentricity of the component parts during production. During operation, the aerosol tip mechanism provides for lower head losses and more homogeneous particle sizes. When used in conjunction with a one-way outlet valve, the aerosol tip mechanism also provides for long-term sterility of the stored fluid, which in turn allows for preservation of the sterility of non-chemically preserved formulations. The fluid dispensed may be in form of suspension and liquid gels.

DETAILED DESCRIPTION OF THE INVENTION

Figure 1:
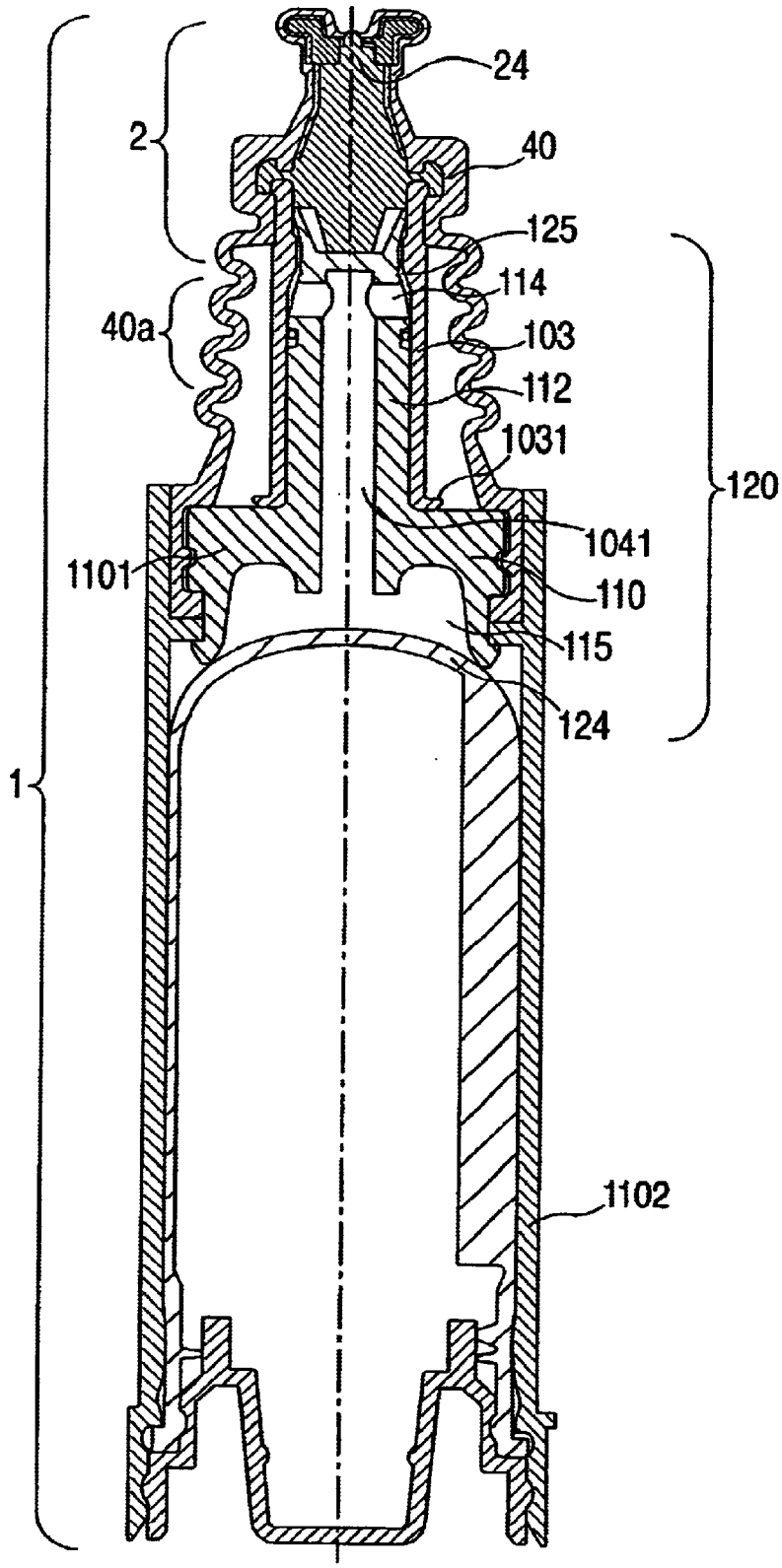
FIG. 1 is a cross-sectional view along the length of an aerosol dispenser including one embodiment of an aerosol tip mechanism, including a nozzle portion, according to the present invention.

An aerosol-type dispenser system 1 including a first exemplary embodiment of an aerosol tip mechanism 2 according to the present invention is shown in FIG. 1. As shown in FIG. 1, a first exemplary embodiment of the aerosol tip 2 according to the present invention is coupled to a body portion 103 which has a substantially tubular shape and to a piston 110 having a substantially tubular portion 112 extending inside and along the body portion 103. The body portion 103 includes a lower base portion 1031 that extends radially beyond a lower end of the body portion 103 in a flange-like structure which is against the piston shoulder 1101 when the pump is in its resting position. A flexible outer shell 40 covers both the aerosol tip mechanism 2 and the body portion 103. The tubular portion of the piston contains a hollow axial inner channel 1041 which communicates fluid toward the body portion 103 via a radial channel 114 on each side of the inner channel 1041 when the pump is in a loaded or "cocked" position.

As shown in FIG. 1, the inner channel of the piston 1041 is in fluid communication with a liquid reservoir 115. The overall pump mechanism 120, which includes the piston 110, the body portion 103, and the flexible outer shell 40, channels the liquid from the liquid reservoir 115 along a fluid communication path encompassing the radial opening 114 in the piston 110 and a compression chamber 125. In this regard, it should be noted that the aerosol tip according to the present invention is intended to be used in conjunction with a wide variety of liquid dispensing systems, one example of which (shown in FIG. 1) combines a spring mechanism (defined by portion 40A of the flexible outer shell 40) and a collapsible bladder 124. The collapsible bladder is surrounded by a rigid spray container 1102. It should be understood that the pump mechanism 120 is merely an exemplary representation of a wide variety of dispensing systems. In the configuration shown, the piston 110 and the rigid spray container 1102 comprise one piece.

Figure 2:
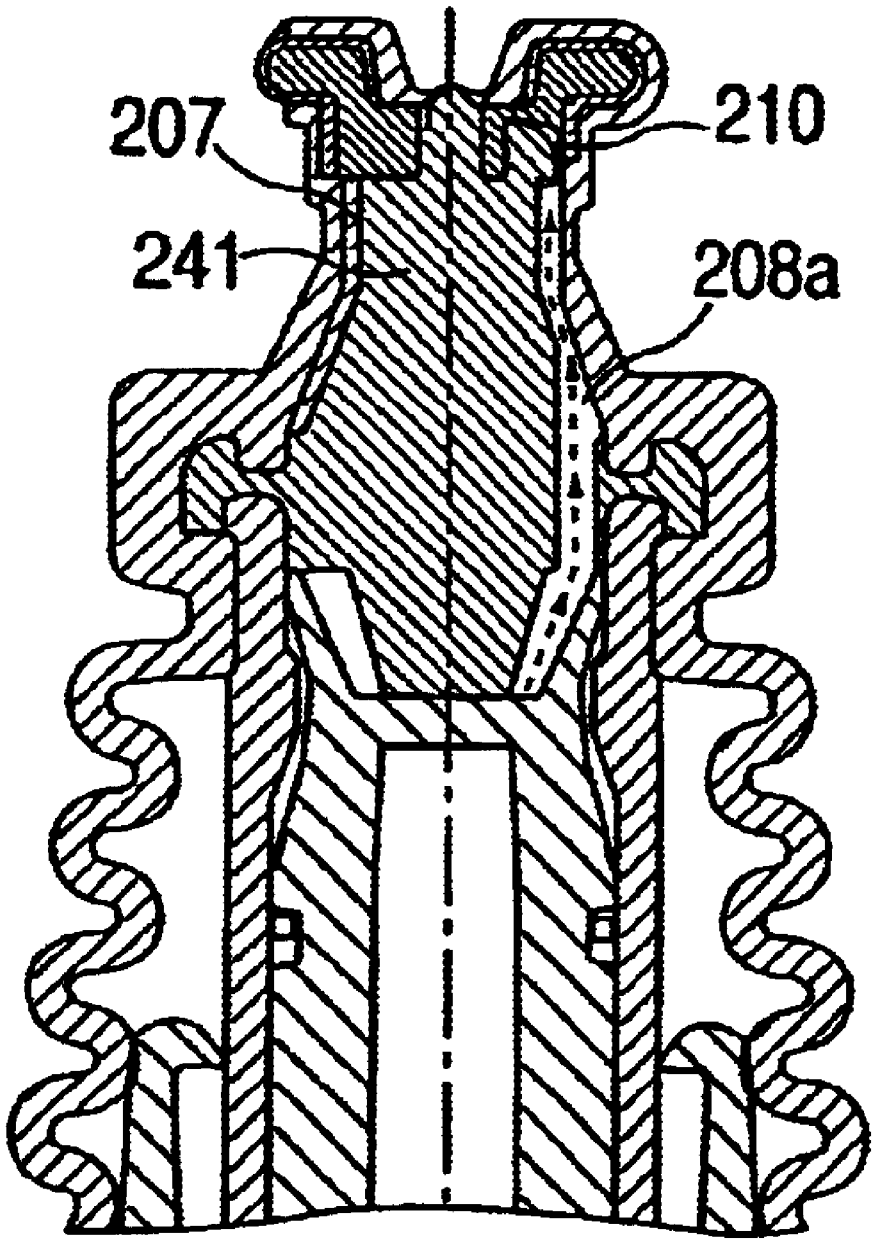
FIG. 2 is a cross-sectional view illustrating the flow path of liquid through the fluid communication path between the pump and the aerosol tip mechanism shown in FIG. 1.

When the piston 110 is slid downward relative to the body portion 103, liquid from the liquid reservoir 115 is initially channeled through the radial opening 114 in the piston 110 and subsequently channeled into the compression chamber 125 when the pump is cocked. When the piston 110 is released, the spring mechanism forces the piston 110 upward, in turn forcing the trapped liquid through outflow channel holes 208*a*, 208*b*, 208*c* of the nozzle and upward to the aerosol tip 2 of the dispenser system. FIG. 2 is a cross-sectional view showing one of the channel holes, hole 208*a*.

Figure 7:
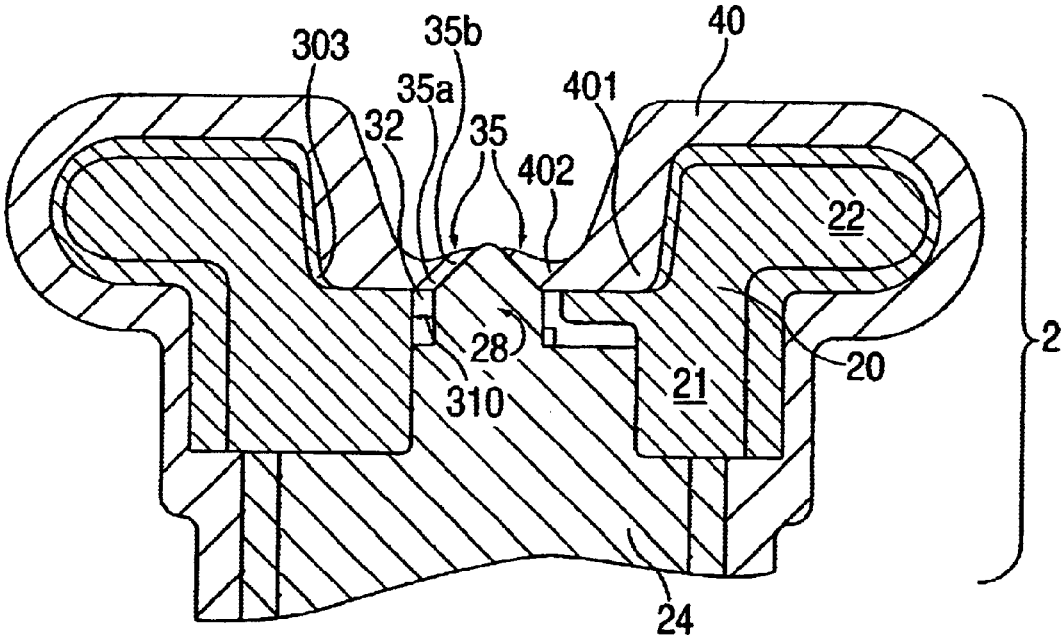
FIG. 7 shows a cross section of the outlet section of the aerosol-tip mechanism according to the present invention.
Figure 8:
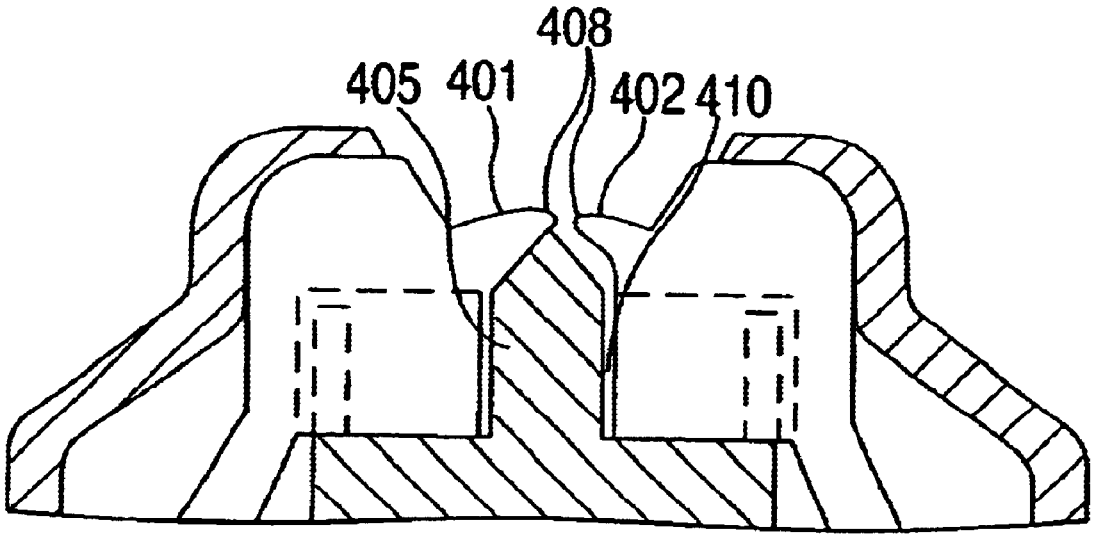
FIG. 8 shows a cross section of an aerosol-tip mechanism, illustrating an example of asymmetry which may occur in aerosol-tip mechanisms.

FIG. 7 shows a first exemplary embodiment of the aerosol tip mechanism 2 according to the present invention. The tip mechanism 2 includes a rigid annular cap portion 20, which has an inner cap portion 21 situated beneath a cap flange 22, and a rigid nozzle portion 24 having a shaft 28 received within the center of the inner portion 21 of the annular cap 20. A swirling chamber 32 lies in the space defined by the inner portion 21 of the cap 20 and the rigid center shaft 28. A flexible outer shell 40, which surrounds and substantially constrains the nozzle portion 24 and the cap flange 22, interfaces with the inner cap portion 21 and the center shaft 28 to form a normally-closed one-way outlet valve 35 which encloses the swirling chamber 32. When the pressure in the swirling chamber 32 is high enough to expand the thick base 35*a* of the one-way outlet valve 35, the thin and distal portion 35*b* of the valve subsequently opens (at which time the thick base 35*a* has already collapsed back to its normally-closed position), thereby providing for one-way discharge of fluid from the outlet valve.

Figure 3:
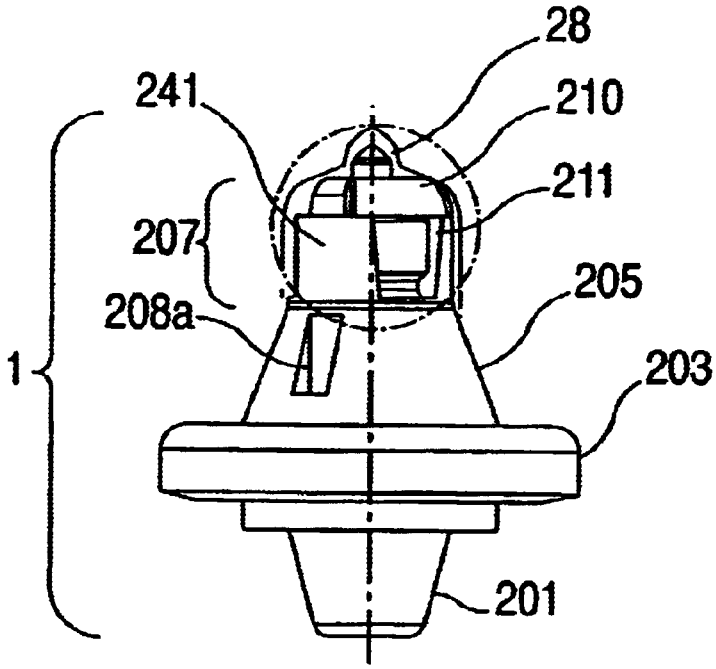
FIG. 3 shows an exemplary frontal elevation of the nozzle portion of the aerosol tip according to an embodiment of the present invention.
Figure 4:
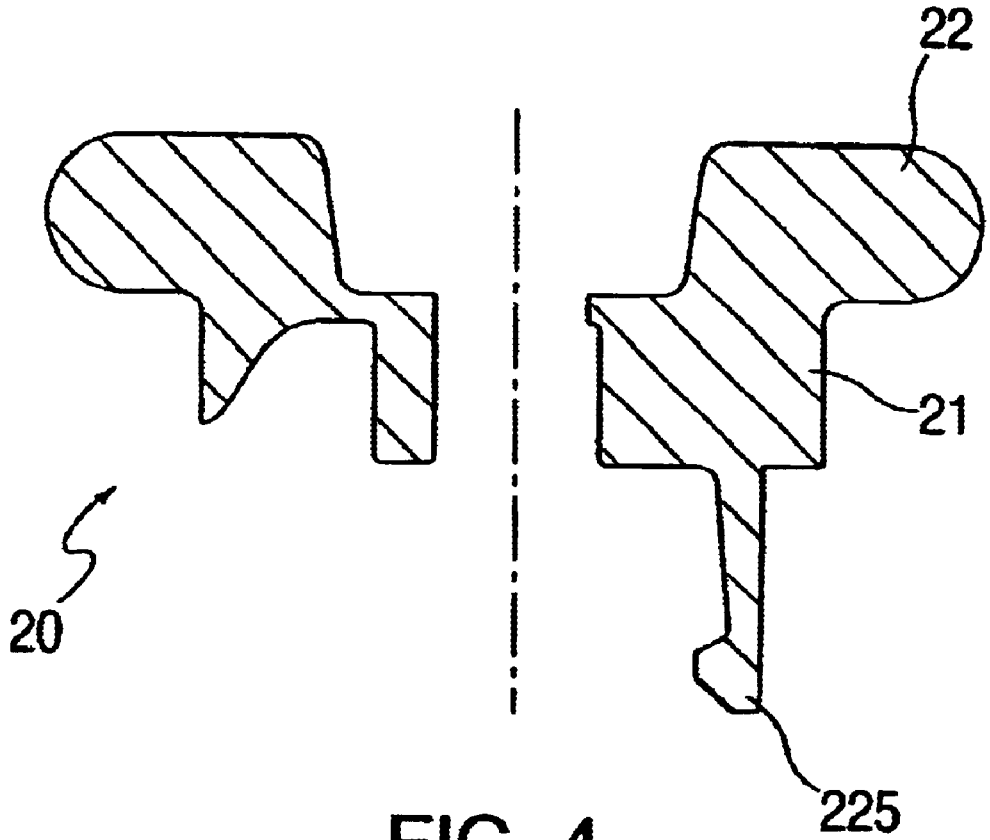
FIG. 4 shows an enlarged cross-sectional view along the length of the cap element of the aerosol tip of the embodiment shown in FIG. 3.

FIG. 3 shows an enlarged view of an embodiment of the rigid nozzle portion 24 of the aerosol tip 2 according to the present invention. The nozzle 24 includes a circular base section 201 widening in a radial direction along the elongated axis of the dispenser system, and the base section 201 is connected to a circular rim 203. On top of the circular rim 203, the nozzle 24 narrows along the elongated axis in a conic section 205. Vertical outflow channel holes, such as 208*a* which extends through the rim 203 and the conic section 205, provide fluid communication channels for liquid entering the swirling chamber, as shown in FIG. 2. The conic section 205 narrows into a cylindrical section 241 which, in between each of the outflow paths of the outflow channel holes, presents an undercut or depression 211 designed to accept and fasten corresponding cap latches 255 of the cap 20, which is shown in FIG. 4, to form a tight seal between the cap 20 and the nozzle 24 of the aerosol tip 2. A valve section 207 is formed between the flexible shell 40 and the cylindrical portion 241.

Figure 5:
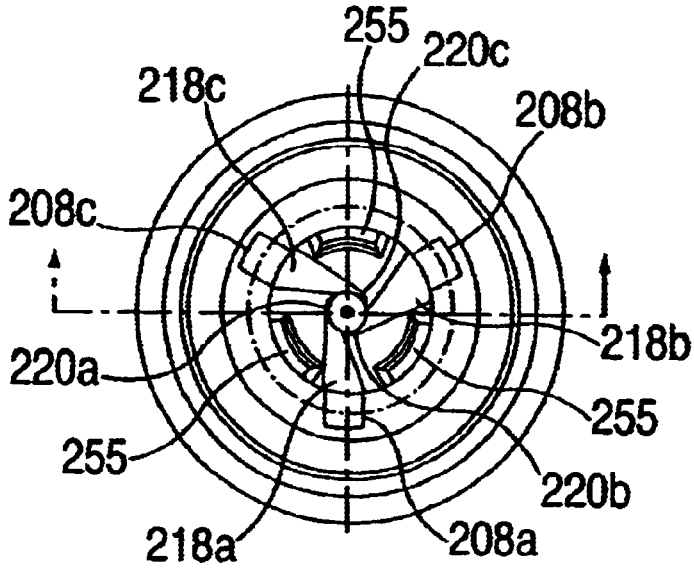
FIG. 5 shows a top plan view of an embodiment of the nozzle portion of the aerosol tip of the embodiment shown in FIG. 3.

Referring back to FIGS. 2 and 5, liquid forced upward through the channel holes 208*a*, 208*b*, 208*c* in the nozzle 24 are channeled along the vertical section 207 to a nozzle spiral feed channel section 210. It is noted that although there are three channel holes in the figures, this number is merely exemplary. Referring to FIG. 5, which shows a top plan view of the nozzle 24, the channel holes 208*a*, 208*b*, 208*c* feed liquid via valve section 207 to the bottom of corresponding spiral feed channels 218*a*, 218*b*, and 218*c*, and it should be apparent that the interface between the nozzle 24 and the cap 20 define the spiral feed channels and the connection section between the channel holes and the feed channels.

A brief description of the fluid mechanics involved in the spiral feed channels 218*a, b, c* and the swirling chamber 32 is helpful here. The swirling chamber 32 is used to create a spray pattern for the discharged aerosol, and several factors affect the physical characteristics of discharged spray pattern. First, the length of the interface defining the outlet valve 35 is the main parameter controlling the cone angle of the spray pattern, i.e., the shorter the length of the interface at the outlet valve 35, the wider the spray pattern. Second, the greater the pressure differential between the outside and the inside of the outlet valve 35, the greater the homogeneity of the particles and the smaller the particle size. Third, the smaller the diameter of the opening defined by the separated outlet valve 35, the smaller the particle size in the spray. Additionally, the symmetry and tightness of the outlet valve 35 impacts the size of the aerosol droplets because of asymmetries in the interface, e.g., if the portion of the flexible outer shell comprising part of the outlet valve 35 is not centered on the center shaft 28, then the tightness of the valve will not be uniform and the valve 35 will not be able to achieve the desired aerosol spray.

In order to increase the homogeneity of the spray-particle size and generally reduce the particle size, the dispensing system according to the present invention maximizes the relative pressure differential between the outside and the inside of the outlet valve 35 by means of minimizing the resistance sources in the fluid path, also referred to as "head loss" in fluid mechanics. In this regard, the following parameters are minimized: the length of the fluid channels incorporated in the present invention; the rate of reduction of the fluid-channel width as the fluid channel approaches the swirling chamber 32; and the rate of change of the fluid-channel angle relative to the swirling chamber, i.e., the transition angle between the channel holes 208*a*, 208*b*, 208*c* and the corresponding spiral feed channels 218*a*, 218*b*, and 218*c* are inclined as gradually as possible without unduly extending their overall length in order to reduce the K factor of the minor loss equation (3).

Figure 6:
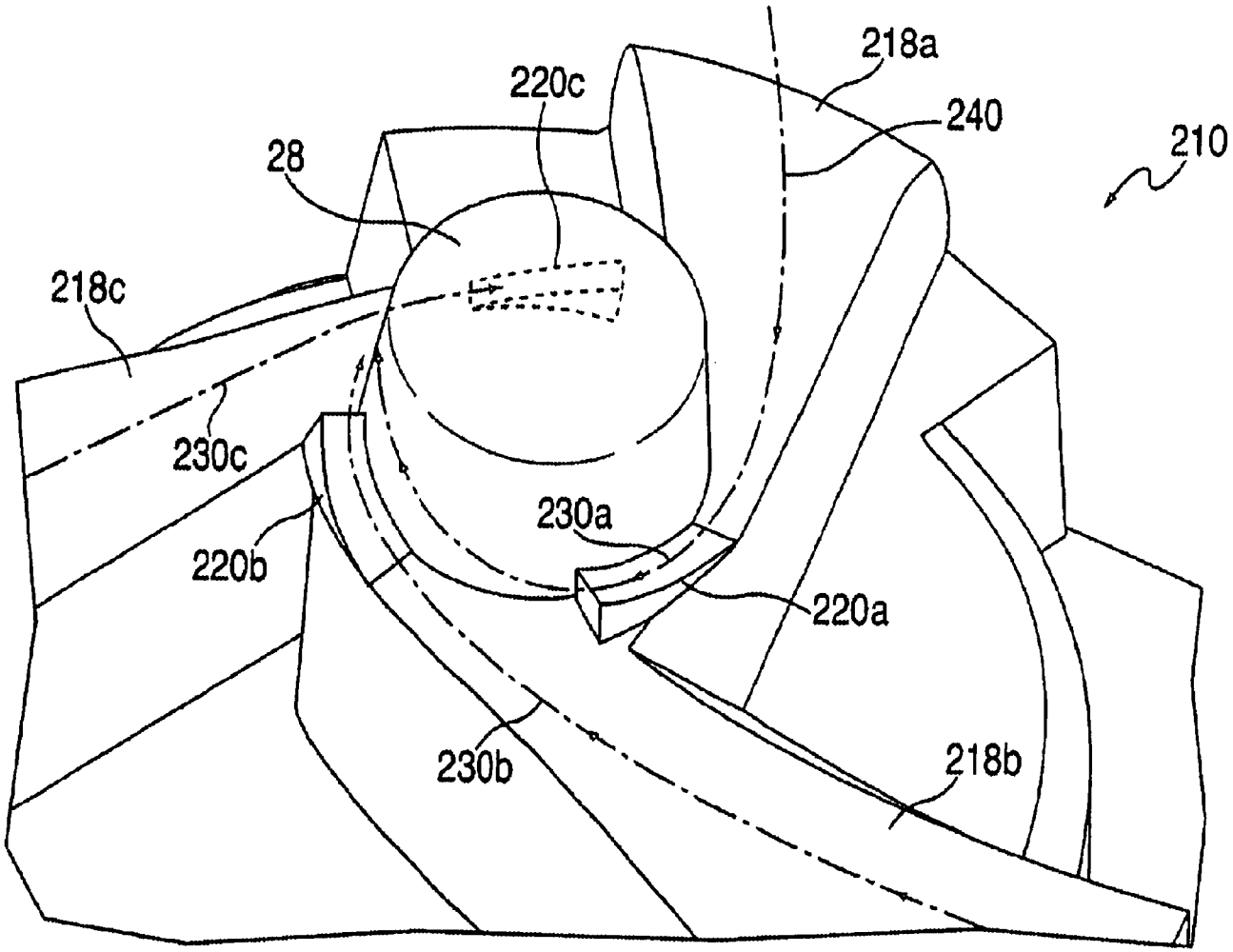
FIG. 6 shows a perspective view of the ramp section and center shaft of the nozzle portion of the embodiment shown in FIG. 3.

As can be seen from FIGS. 5 and 6, each spiral feed channel 218*a*, 218*b* and 218*c* is widest at its respective bottom portion and becomes narrower as it gradually curves upward in a clockwise direction around the center shaft 28 so that the head loss is reduced due to two effects: a) because of the shorter length of the narrow end of the feed channels, and b) the smoother curve between the vertical portion of the shaft 28 and the horizontal end of the feed channels. Liquid that is channeled upwards along the spiral channels 218*a*, 218*b*, 218*c* travels along a gradual, clockwise-curving path (such as path 240 shown in FIG. 6) and suffers only relatively minor head losses because of the absence of sharp edges or turns along the path which contribute to head losses. Each spiral feed channel 218*a, b, c* narrows into a ledge surrounding the center shaft 28, each of which feed channel ends with an upwardly sloping and curving ramp 220*a*, 220*b*, 220*c*. Liquid streams travel along the ramps 220*a, b, c*, and spiral upwards around the center shaft 28 in an annular swirling chamber 32 situated between the shaft and the cap portion 20 which has an internal profile complementary to the ramp of the nozzle. Because the ramps 220*a, b* and *c* are angled 120 degrees apart from one another, the spiral trajectories of the liquid channeled from each ramp into the swirling chamber 32 are spaced apart from one another such that the liquid expelled in trajectory 230*a* from the ramp 220*a* to the chamber 32 reaches halfway to the top of the swirling chamber before this liquid merges with the liquid 230*b* entering the swirling chamber 32 from an adjacent spiral feed channel 218*b*. The mutual non-interference of liquid flowing in the separate trajectories 230*a*, 230*b*, 230*c* (not shown) from the corresponding spiral feed channels 218*a*, 218*b*, 218*c* also assists in minimizing head losses, as interference between the liquid streams can also cause head losses and/or turbulence. Using the embodiment of the aerosol tip incorporating the spiral feed channels 218*a*, 218*b*, and 218*c* and the swirling chamber shown in FIG. 6, the average particle size of the discharged spray pattern is below 40 $\mu$m, and is sprayed in a more homogeneous pattern as judged by the narrow deviation of particle sizes according to the Melverne test.

Returning to FIG. 7, the mechanism for ensuring the centering of the flexible outer shell 40 over the center shaft 28, thereby ensuring a symmetrical and tight outlet valve interface 35 between the flexible outer shell 40 and the center shaft 28, is illustrated. The outlet portion of the outer shell 40 rests between the upper, or the flange, portion 22 and the lower portion 21 of the cap 20 in the shape of a foot, with the heel 401 and the "toes" 402 of the outlet portion of the shell 40 forming the outlet valve 35 in conjunction with the rigid shaft, and the "heel" of the outlet portion immovably fixed in the boots 303 where the flange 22 connects to the lower portion 21 of the rigid cap 20. The rigid cap 20 is also immovably fixed in relation to the center shaft 28, such that there is an annular clearance and constant distance 310 between the lower portion of the cap 21 and the shaft 28, which clearance 310 provides space for the swirling chamber 32, and also fixes the distance between the boots 303 and the outlet valve 35, providing for exact concentricity between the components during assembly. For the purpose of providing a firm guide for centering the cap 21 onto the shaft 28, both components are made from rigid materials such as poly acetal, polycarbonate or polypropylene, while the elastic outlet valve portion 35, made from KRATON™, polyethylene, polyurethane or other plastic materials, thermoplastic elastomers or other elastic materials, is free to adjust and fit concentrically within the rigid boots 303. By constraining the lateral movement of the outer shell 40, the length of the outlet valve 35 can be precisely dimensioned to tightly enclose the swirling chamber 32 without having to add additional constraints to account for improper alignment during assembly.

The one-way valve described herein prevents external contaminants from contacting the fluid within the spray container, and allows the fluid to remain sterile indefinitely. An advantage of the aerosol tip according to the present invention is that the number of parts which constitute the aerosol tip mechanism is reduced in comparison to conventional aerosol-tip and nozzle mechanisms, i.e., these conventional mechanisms typically include gaskets and dead volumes, as well as allowing direct communication between the pump and the external air, making a one-way valve of the type described herein impracticable. As can be seen from FIG. 7, the aerosol tip according to the present invention can be made from three discrete parts: a flexible outer shell 40, a rigid cap portion 20 and a rigid nozzle portion 24 including a rigid shaft portion. Because only three discrete parts are required, the cost and complexity of manufacturing are reduced.

Yet another advantage of the aerosol tip according to the present invention is that the configuration of the outlet valve portion 35 of the aerosol tip is preserved and prevented from either over and under-extending laterally with respect to the shaft of the nozzle portion in response to the forces applied by the pressurized fluid in the fluid channel.

Still another advantage of the aerosol tip according to the present invention is that the average fluid-particle size in the dispensed aerosol spray is optimally controlled and generally reduced owing to the configuration of the fluid channels which are designed specifically to limit head losses. Average fluid-particle size is also optimally controlled by maintaining exact concentricity of the components of the symmetrical outlet valve, which greatly reduces the risk of undesirable discharge-particle characteristics and assures better reproducibility of desired discharge-particle characteristics from pump to pump.

While specific embodiments have been described above, it should be readily apparent to those of ordinary skill in the art that the above-described embodiments are exemplary in nature since certain modifications may be made thereto without departing from the teachings of the invention, and the exemplary embodiments should not be construed as limiting the scope of protection for the invention as set forth in the appended claims.

What is claimed is:

1. An aerosol tip mechanism for an aerosol-type dispenser for dispensing liquid content, the aerosol tip mechanism comprising:

a flexible outer shell having an outlet portion;

a rigid cap portion positioned inside the flexible outer shell in the vicinity of the outlet portion, the rigid cap portion constraining a lateral motion of the outlet portion of the outer shell; and a rigid nozzle portion having a rigid shaft received within the outlet portion of the flexible outer shell and interfacing said outlet portion of the outer shell to form a first normally-closed valve;

wherein the rigid cap portion symmetrically centers the outlet portion of the flexible outer shell around the rigid shaft of the nozzle.

2. The aerosol tip mechanism of claim 1, further comprising:

a swirling chamber laterally delimited by the rigid shaft and interior of the cap portion, and vertically delimited by the outlet portion of the outer shell;

wherein liquid content of the swirling chamber is expelled from the swirling chamber via the first normally-closed valve.

3. The aerosol tip mechanism of claim 2, wherein the aerosol tip mechanism is in fluid communication with a liquid reservoir, and wherein the rigid nozzle portion includes a plurality of fluid channels, the plurality of fluid channels leading to a plurality of gradually curved spiral feed channels, each spiral feed channel expelling liquid in a spiral path in the swirling chamber, the plurality of spiral feed channels being gradually curved to minimize energy losses of the liquid as the liquid flows through the feed channels.

4. The aerosol tip mechanism of claim 1, wherein the cap portion includes an axially extending latch member and the rigid nozzle portion includes a groove adapted to receive the latch member of the cap portion to provide an interlocking fit between the cap portion and the nozzle portion.

5. The aerosol tip mechanism of claim 2, wherein the cap portion has lower and upper portions, wherein interior radial edge of the lower portion of the cap portion and the rigid shaft of the nozzle portion are separated by a fixed clearance distance, the clearance distance defining a lateral extent of the swirling chamber.

6. The aerosol tip mechanism of claim 3, wherein the outlet portion of the flexible outer shell distends in a direction away from the rigid shaft during an opening of the normally-closed valve, whereby an initial point of separation between the outlet portion of the flexible outer shell and the rigid shaft is substantially closed when a final point of separation between the outlet portion and the rigid shaft is open.

7. An aerosol tip mechanism for an aerosol-type dispenser for dispensing liquid content by application of pressure, the aerosol tip mechanism comprising:

a flexible outer shell having an outlet portion;

a rigid cap portion having a boot-shaped segment, the boot-shaped segment being positioned inside the flexible outer shell in the vicinity of the outlet portion, the boot-shaped segment constraining a lateral motion of the outlet portion of the outer shell;

a rigid nozzle portion having a rigid shaft received within the outlet portion of the flexible outer shell and interfacing said outlet portion of the outer shell to form a first normally-closed valve; and a swirling chamber laterally delimited by the rigid shaft and interior of the cap portion, and vertically delimited by the outlet portion of the outer shell;

wherein the boot-shaped segment of the cap portion symmetrically centers the outlet portion of the flexible outer shell around the rigid shaft of the nozzle, and wherein liquid content of the swirling chamber is expelled from the swirling chamber via the first normally-closed valve.

8. The aerosol tip mechanism of claim 7, wherein the aerosol tip mechanism is in fluid communication via a second one-way valve with a liquid reservoir, and wherein the rigid nozzle portion includes a plurality of fluid channels, the plurality of fluid channels leading to a plurality of gradually curved spiral feed channels, each spiral feed channel expelling liquid in a spiral path in the swirling chamber, the plurality of spiral feed channels being gradually curved to minimize energy losses of the liquid as the liquid flows through the feed channels.

9. The aerosol tip of claim 8, wherein each of the plurality of spiral feed channels, at an end proximate to the rigid shaft, includes a ramp element which diverts channeled fluid into the swirling chamber at upwardly sloping angle.

10. The aerosol tip of claim 9, wherein each of the plurality of spiral feed channels releases fluid in a trajectory into the swirling chamber via a ramp element, each trajectory being substantially separated from trajectories of liquid from other feed channels such that minimal interference occurs between fluid traveling in separate trajectories.

11. The aerosol tip mechanism of claim 8, wherein the cap portion includes an axially extending latch member and the rigid nozzle portion includes a groove adapted to receive the latch member of the rigid cap portion to provide an interlocking fit between the cap portion and the nozzle portion.

12. The aerosol tip mechanism of claim 8, wherein the outlet portion of the flexible outer shell distends in a direction away from the rigid shaft during an opening of the first normally-closed one-way valve, whereby an initial point of separation between the outlet portion of the flexible outer shell and the rigid shaft is substantially closed when a final point of separation between the outlet portion and the rigid shaft is open.

13. A method of optimally controlling proper interface of components forming an aerosol tip mechanism, the aerosol tip having a flexible outer shell with an outlet portion; a rigid cap portion positioned inside the flexible outer shell; and a rigid nozzle portion having a rigid shaft received within the outlet portion of the flexible outer shell and interfacing said outlet portion of the outer shell to form a first normally-closed valve, the method comprising the steps of:

constraining a lateral motion of the outlet portion of the flexible outer shell by interfacing the rigid cap portion with an interior surface of the flexible outer shell near the outlet portion; and arranging the outlet portion of the flexible outer shell around the rigid shaft, whereby symmetrical arrangement of the outlet portion of the flexible outer shell relative to the rigid shaft is achieved by the interface of the rigid cap portion and the outlet portion.

* * * * *